US006668145B2

(12) United States Patent
Wang et al.

(10) Patent No.: US 6,668,145 B2
(45) Date of Patent: Dec. 23, 2003

(54) TONER CARTRIDGE OPENING CONTROL ARRANGEMENT

(75) Inventors: Jui-Chi Wang, Taichung (TW); Robin Hsu, Taichung (TW); Ren-Hao Liu, Taichung (TW)

(73) Assignee: General Plastic Industrial Co., Ltd. (TW)

( * ) Notice: Subject to any disclaimer, the term of this patent is extended or adjusted under 35 U.S.C. 154(b) by 0 days.

(21) Appl. No.: 10/128,467

(22) Filed: Apr. 22, 2002

(65) Prior Publication Data

US 2003/0198486 A1 Oct. 23, 2003

(30) Foreign Application Priority Data

Mar. 8, 2002 (TW) ..... 91203001 U

(51) Int. Cl.[7] ..... G03G 15/08
(52) U.S. Cl. ..... 399/258; 399/260; 399/262
(58) Field of Search ..... 399/258, 259, 399/260, 262, 103, 104, 106, 119, 120, 263; 141/364

(56) References Cited

U.S. PATENT DOCUMENTS 5,018,560 A * 5/1991 Tsukamoto ..... 399/258
5,294,963 A * 3/1994 Nakano et al. ..... 141/364
5,329,340 A * 7/1994 Fukuchi et al. ..... 399/260
5,520,229 A * 5/1996 Yamada ..... 141/364
6,269,234 B1 * 7/2001 Kurz et al. ..... 399/258
6,289,193 B1 * 9/2001 Ban et al. ..... 399/258
2002/0001485 A1 * 1/2002 Ichikawa et al. ..... 399/262
2002/0025192 A1 * 2/2002 Matsuda et al. ..... 399/258

FOREIGN PATENT DOCUMENTS

JP 06035318 A * 2/1994 ..... G03G/15/08

* cited by examiner

*Primary Examiner*—Sandra Brase
(74) *Attorney, Agent, or Firm*—Merchant & Gould LLC

(57) ABSTRACT

A toner cartridge opening control arrangement is constructed to include a toner cartridge for accommodating toner, the toner cartridge having an opening for output of the toner into a toner receiving container, a removable sealing member adapted to close/open the opening of the toner cartridge, a force applying member for receiving an external pulling force to move the removable sealing member, a magnetism device for imparting an outward pressure to the force applying member, and a releasable locking device adapted to lock the force applying member.

15 Claims, 5 Drawing Sheets

TONER CARTRIDGE OPENING CONTROL ARRANGEMENT

BACKGROUND OF THE INVENTION

1. Field of the Invention

The present invention relates to a toner cartridge for replenishing toner into an image forming apparatus and, more particularly, to a toner cartridge opening control arrangement for controlling the opening of the toner supply opening of the toner cartridge.

2. Description of the Related Art

The design of U.S. Pat. No. 6,289,193, entitled "TONER SUPPLY CONTAINER AND TONER RECEIVING CONTAINER FOR RECEIVING TONER FROM SAME" uses an magnetic member to urge the force applying portion from a predetermined position in the direction of removing the sealing member. The arrangement of the magnetic member is complicated, resulting in high manufacturing cost of the toner supply container.

SUMMARY OF THE INVENTION

The present invention has been accomplished to provide a toner cartridge opening control arrangement, which eliminates the aforesaid drawbacks. It is one object of the present invention to provide a toner cartridge opening control arrangement, which is simple and inexpensive to manufacture. According to one aspect of the present invention, the toner cartridge opening control arrangement is constructed to include a toner cartridge for accommodating toner, the toner cartridge having an opening for output of the toner into a toner receiving container, a removable sealing member adapted to close/open the opening of the toner cartridge, a force applying member for receiving an external pulling force to move the removable sealing member, a magnetism device for imparting an outward pressure to the force applying member, and a releasable locking device adapted to lock the force applying member. According to another aspect of the present invention, the magnetism device comprises a plurality of first magnets respectively provided at the toner cartridge, and a plurality of second magnets respectively provided at the force applying member and reversely aimed at the first magnets for producing a magnetic repulsive force to force the force applying member outwards from the cartridge toner.

DETAILED DESCRIPTION OF THE PREFERRED EMBODIMENT

Figure 1:
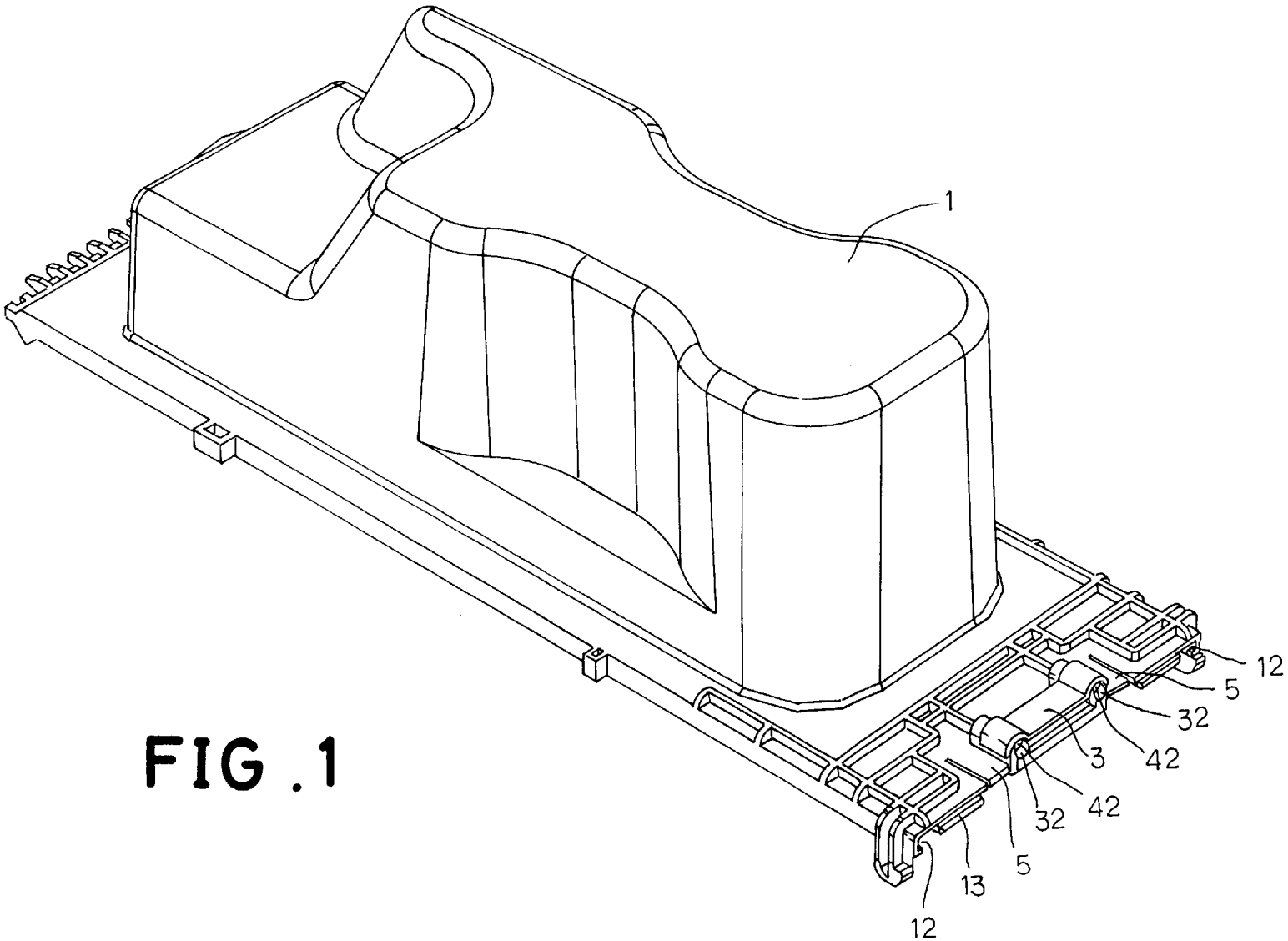
FIG. 1 is an elevational view of a toner cartridge opening control arrangement according to the present invention.
Figure 2:
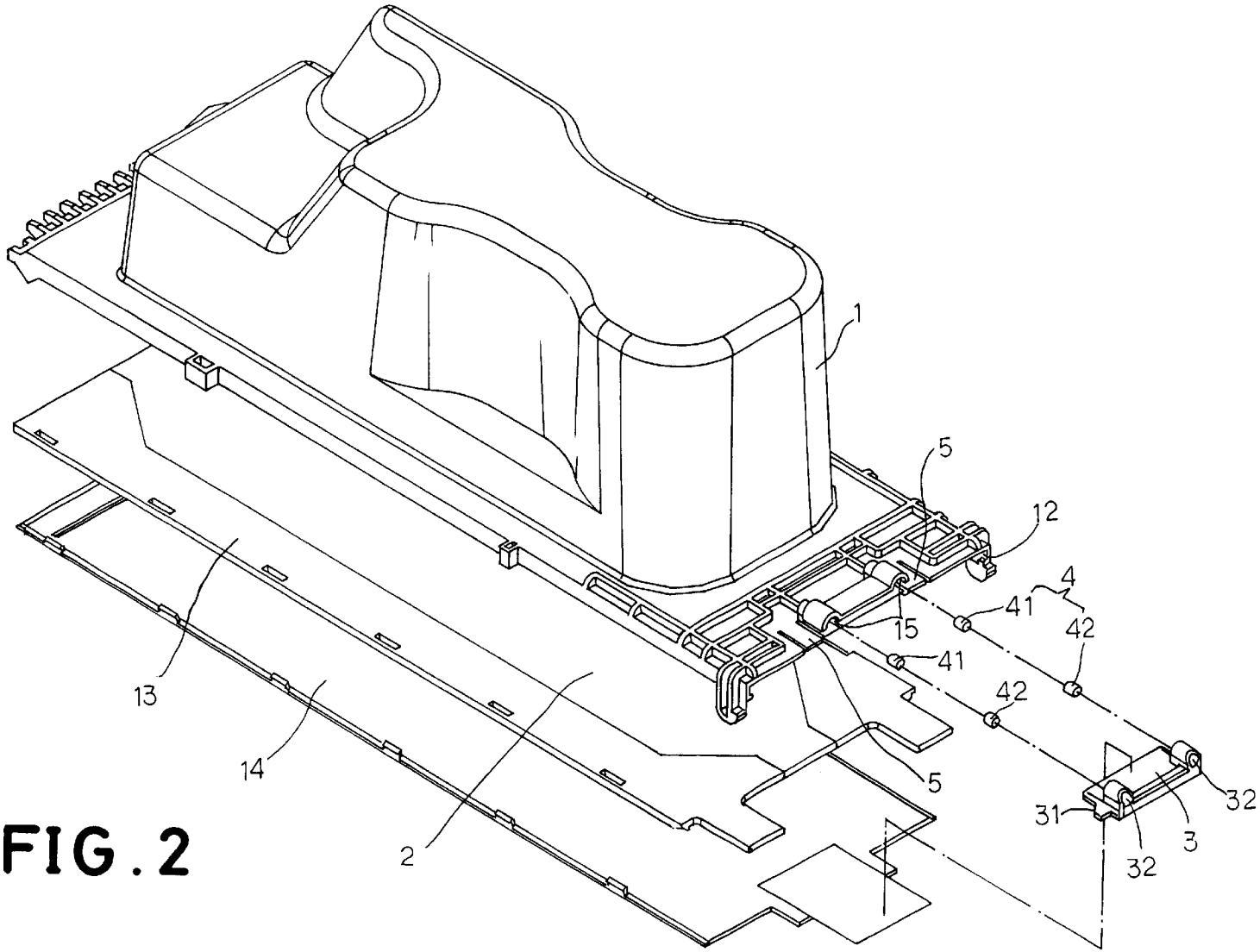
FIG. 2 is an exploded view of the developer supply container according to the present invention.

Referring to FIGS. 1 and 2, a toner cartridge opening control arrangement in accordance with the present invention is shown comprised of a toner cartridge 1 for accommodating toner, a removable sealing member 2, a force applying member 3, a magnetism device 4, and a releasable locking device 5.

Figure 5:
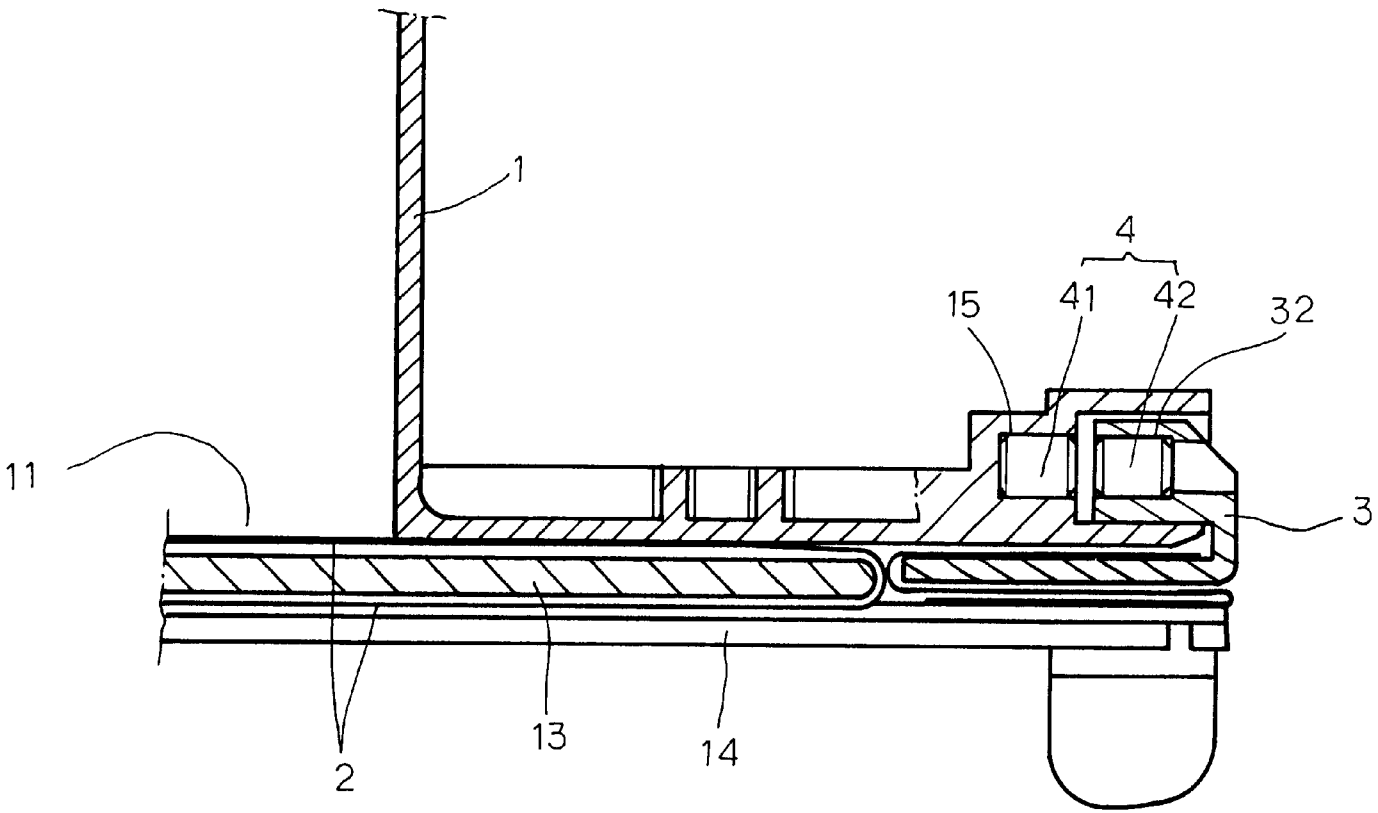
FIG. 5 is a sectional side view in an enlarged scale of a part of the developer supply container shown in FIG. 1.

Referring to FIG. 5 and FIGS. 1 and 2 again, the toner cartridge 1 is a container provided with a bottom opening 11 for permitting supply of the toner into a toner receiving container (not shown), and two sliding rails 12 at two sides of the bottom opening 11. The toner cartridge 1 further comprises a first cover plate 13 and a second cover plate 14. The first cover plate 13 is moved along the sliding rails 12 to close/open the bottom opening 11.

Referring to FIGS. 2 and 5 again, the bottom opening 11 of the toner cartridge 1 is sealed by the removable sealing member 2. The removable sealing member 2 is a thin film member covered over the first cover plate 13 and adhered to an outer side of the rear part of the bottom opening 11 of the toner cartridge 1. When the first cover plate 13 moved in one direction by an external force, the removable sealing member 2 is torn down from the bottom opening 11, permitting supply of the toner into the toner receiving container.

Referring to FIGS. 2 and 5 again, the force applying member 3 is provided at the rear side of the second cover plate 14, comprising two lugs 31 disposed at two sides. When applied a pulling force to the force applying member 3, the second cover plate 14 is moved outwards with the force applying member 3 to carry the first cover plate 13 outwards, and therefore the removable sealing member 2 is moved with the first cover plate 13 to open the bottom opening 11 of the toner cartridge 1. The aforesaid force applying member 3 is a pull plate convenient for the holding of the hand to pull the removable sealing member 2 from the close position to the open position.

Figure 3:
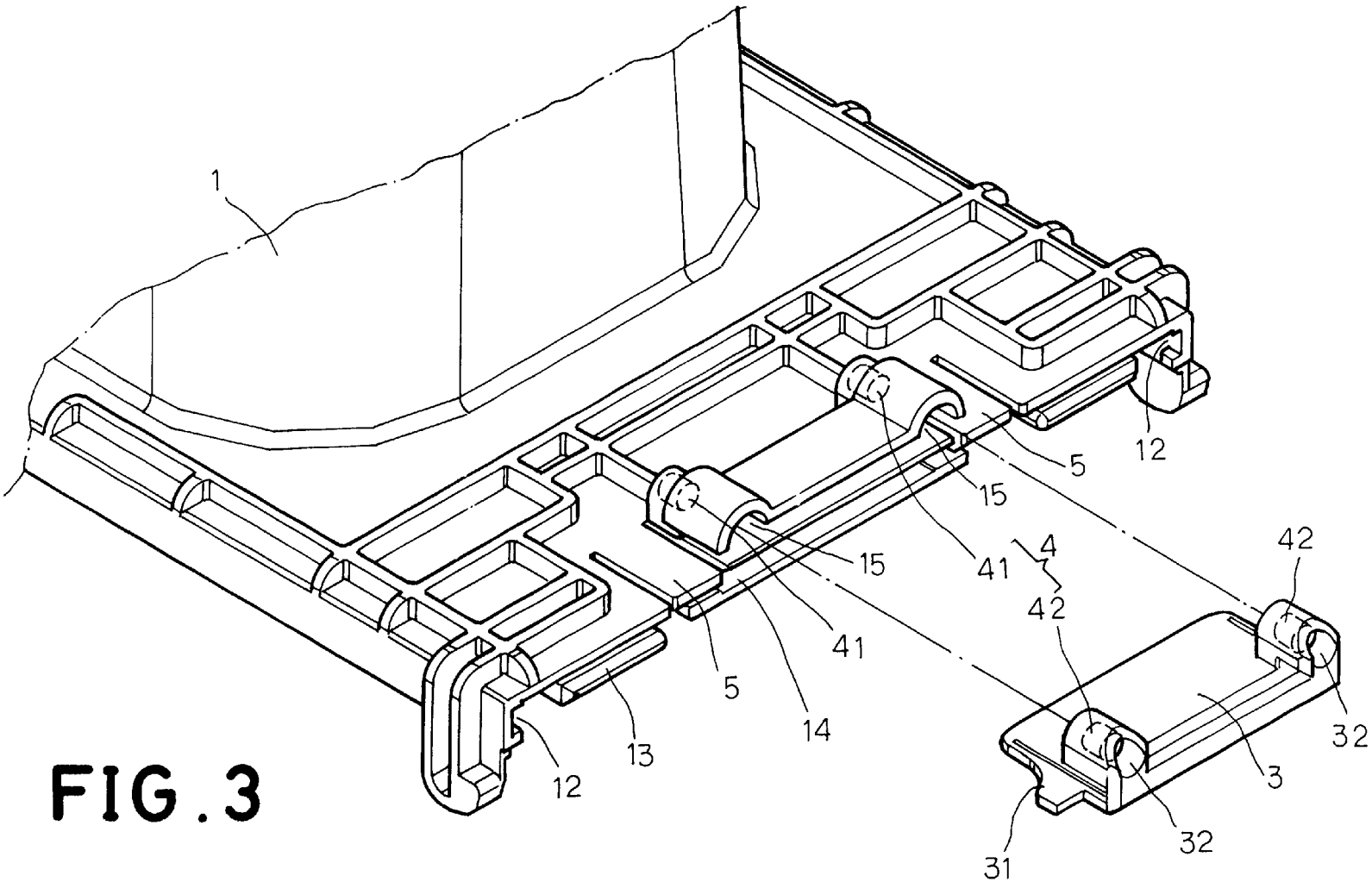
FIG. 3 is an enlarged view of a part of FIG. 2.

Referring to FIG. 3 and FIG. 5 again, the magnetism device 4 comprises at least one, for example, two first receptacles 15 provided at the rear side of the toner cartridge 1, two first magnets 41 respectively installed in the first receptacles 15, two second receptacles 32 provided at the force applying member 3, and two second magnets 42 respectively installed in the second receptacles 32 and respectively reversely aimed at the first magnets 41. By means of magnetic repulsion between the first magnets 41 and the second magnets 42, the magnetism device 4 imparts an outward pressure to the force applying member 3.

Figure 4:
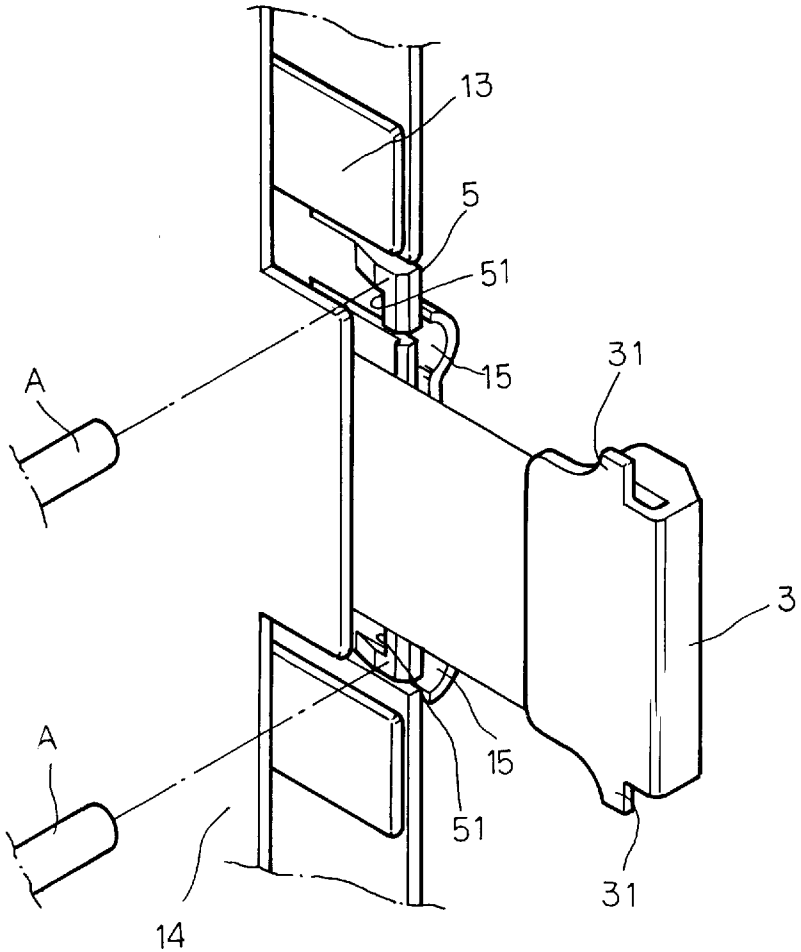
FIG. 4 is a perspective view in an enlarged scale of the present invention showing the action of the force applying member.

Referring to FIG. 4 and FIG. 2 again, the releasable locking device 5 is provided at the rear side of the toner cartridge 1, comprising two bottom hooks 51 disposed at two sides of the first receptacles 15 for hooking on the lugs 31 of the force applying member 3 to hold the removable sealing member 2 and the force applying member 3 in the close position. When the bottom hooks 51 disengaged from the lugs 31 of the force applying member 3, the magnetism device 4 immediately forces the removable sealing member 2 and the force applying member 3 outwards from the close position to the open position to open the bottom opening 11 of the toner cartridge 1.

As indicated above, the first cover plate 13 is slidably mounted in the sliding rails 12 of the toner cartridge; the removable sealing member 2 is carried on the first cover plate 13 with a part thereof adhered to the rear side of the bottom opening 11 of the toner cartridge 1; the second cover plate 14 is covered on the outer side of the first cover plate 13; and the force applying member 3 is fastened to one end of the second cover plate 14.

Referring to FIGS. from 1 through 5 again, when assembled, the removable sealing member 2 seals the bottom opening 11 of the toner cartridge, and the hooks 51 of the releasable locking device 5 are respectively hooked on the lugs 31 of the force applying member 3 to hold the first cover plate 13 and the second cover plate 14 in the close position. When in use, the toner cartridge 1 is mounted in the image forming apparatus and connected to the toner receiving container of the image forming apparatus (not shown). At this time, rod members A of the image forming apparatus are respectively stopped at the releasable locking device 5 to force the hooks 51 of the releasable locking device 5 away from the lugs 31 of the force applying member 3, permitting formation of magnetic repulsion to force the force applying member 3 outwards. Thus, the user can pull the force applying member 3 with the hand to move the second cover plate 14, the first cover plate 13, and the removable sealing member 2 outwards, and therefore the bottom opening 11 of the toner cartridge 1 is opened, permitting supply of the toner into the toner receiving container.

A prototype of toner cartridge opening control arrangement has been constructed with the features of FIGS. 1~5. The toner cartridge opening control arrangement functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A toner cartridge opening control arrangement for use with a toner cartridge for accommodating toner and having a toner supply opening, where the toner cartridge is mountable to an image forming apparatus, comprising:

a removable sealing member being movable between an open position to open the toner supply opening of said toner cartridge and a close position to close the toner supply opening of said toner cartridge;

a force applying member for receiving an external pulling force to move said removable sealing member from said close position toward said open position;

a permanent magnetism device, which generates a static magnetic field and imparts an outward pressure to said force applying member toward said open position; and a releasable locking device adapted to lock said force applying member in said close position.

2. The toner cartridge opening control arrangement as claimed in claim 1, wherein said force applying member is a pulling plate, which moves with said removable sealing member from said close position to said open position when said releasable locking device is unlocked.

3. The toner cartridge opening control arrangement as claimed in claim 1, wherein said magnetism device is comprised of a plurality of magnets.

4. The toner cartridge opening control arrangement as claimed in claim 1, wherein said releasable locking device comprises at least one hook means hooked on said force applying member, said at least one hook means being disengaged from said force applying member after installation of said toner cartridge in the image forming apparatus.

5. The toner cartridge opening control arrangement as claimed in claim 1, wherein said toner cartridge comprises a first cover plate adapted to move said removable sealing member between said close position and said open position, and a second cover plate adapted to move said first cover plate and said removable sealing member between said close position and said open position.

6. The toner cartridge opening control arrangement as claimed in claim 5, wherein said first cover plate is mounted on said toner cartridge and movable relative to the toner supply opening of said toner cartridge, said removable sealing member is covered over said first cover plate and has a part adhered to a rear side of the opening of said toner cartridge, and said second cover plate is provided at an outer side of said first cover plate, having one end fastened to said force applying member.

7. The toner cartridge opening control arrangement as claimed in claim 6, wherein said first cover plate covers the toner supply opening of said toner cartridge when said removable sealing member is moved to said close position.

8. The toner cartridge opening control arrangement as claimed in claim 6, wherein said second cover plate is movable with said force applying member to carry said first cover plate and said removable sealing member from said close position to said open position.

9. A toner cartridge opening control arrangement for use with a toner cartridge for accommodating toner and having a toner supply opening, where the toner cartridge is mountable to an image forming apparatus, comprising:

a removable sealing member being movable between an open position to open the toner supply opening of said toner cartridge and a close position to close the toner supply opening of said toner cartridge;

a force applying member for receiving an external pulling force to move said removable sealing member from said close position toward said open position;

a permanent magnetism device, which generates a static magnetic field and imparts an outward pressure to said force applying member toward said open position wherein said magnetism device comprises at least one first magnet fixedly provided at said toner cartridge, and at least one second magnet fixedly provided at said force applying member respectively reversely aimed at said at least one first magnet for producing a magnetic repulsive force to force said force applying member outwards from said toner cartridge; and a releasable locking device adapted to lock said force applying member in said close position.

10. The toner cartridge opening control arrangement as claimed in claim 9, wherein said toner cartridge comprises at least one receptacle adapted to hold said at least one first magnet respectively.

11. The toner cartridge opening control arrangement as claimed in claim 9, wherein said force applying member comprises at least one receptacle adapted to hold said at least one second magnet respectively.

12. A toner cartridge opening control arrangement for use with a toner cartridge for accommodating toner and having a toner supply opening, where the toner cartridge is mountable to an image forming apparatus, comprising:

a removable sealing member being movable between an open position to open the toner supply opening of said toner cartridge and a close position to close the toner supply opening of said toner cartridge;

a force applying member for receiving an external pulling force to move said removable sealing member from said close position toward said open position;

a first permanent magnet provided at said toner cartridge; and a second permanent magnet provided at said force applying member adapted for producing a magnetic repulsive force with the first permanent magnet to force said force applying member outwards from said toner cartridge.

13. The toner cartridge opening control arrangement as claimed in claim 12, further comprising a releasable locking device adapted to lock said force applying member in said close position.

14. A toner cartridge for accommodating toner and mountable to an image forming apparatus, where the toner cartridge has a toner supply opening, comprising:

a removable sealing member being movable between an open position to open the toner supply opening of said toner cartridge and a close position to close the toner supply opening of said toner cartridge;

a force applying member for receiving an external pulling force to move said removable sealing member from said close position toward said open position;

a first permanent magnet; and a second permanent magnet provided at said force applying member adapted for producing a magnetic repulsive force with the first permanent magnet to force said force applying member outwards from said toner cartridge.

15. The toner cartridge as claimed in claim 14, further comprising a releasable locking device adapted to lock said force applying member in said close position.

* * * * *